US012474146B2

(12) United States Patent
Melnyk

(10) Patent No.: US 12,474,146 B2
(45) Date of Patent: Nov. 18, 2025

(54) HIGH SPEED ACTUATION SYSTEMS

(71) Applicant: Simmonds Precision Products, Inc., Vergennes, VT (US)

(72) Inventor: Zenon Melnyk, Avon, CT (US)

(73) Assignee: Simmonds Precision Products, Inc., Vergennes, VT (US)

( * ) Notice: Subject to any disclaimer, the term of this patent is extended or adjusted under 35 U.S.C. 154(b) by 263 days.

(21) Appl. No.: 18/092,812

(22) Filed: Jan. 3, 2023

(65) Prior Publication Data

US 2024/0219159 A1 Jul. 4, 2024

(51) Int. Cl.
*F42B 10/02* (2006.01)
*F42B 10/62* (2006.01)

(52) U.S. Cl.
CPC ..... *F42B 10/025* (2013.01); *F42B 10/62* (2013.01)

(58) Field of Classification Search
CPC ..... F42B 10/025; F42B 10/62
See application file for complete search history.

(56) References Cited

U.S. PATENT DOCUMENTS

| | | | | |
|---|---|---|---|---|
| 4,678,142 | A | 7/1987 | Hirschfeld | |
| 4,685,639 | A | 8/1987 | Bains | |
| 5,788,180 | A | 8/1998 | Sallee et al. | |
| 6,216,597 | B1 * | 4/2001 | Bredy | F41G 7/222 102/476 |
| 6,474,593 | B1 | 11/2002 | Lipeles et al. | |
| 7,781,709 | B1 | 8/2010 | Jones et al. | |
| 8,076,623 | B2 | 12/2011 | Dryer | |
| 8,319,162 | B2 | 11/2012 | Mccool | |
| 9,052,171 | B2 | 6/2015 | Rastegar | |
| 10,414,518 | B2 | 9/2019 | Zondervan et al. | |
| 10,597,154 | B1 | 3/2020 | Hoffberg | |
| 10,704,874 | B2 | 7/2020 | Lotan | |
| 11,060,829 | B1 | 7/2021 | Sowle et al. | |

(Continued)

FOREIGN PATENT DOCUMENTS

| | | | | |
|---|---|---|---|---|
| WO | 2002014781 A1 | 2/2002 | | |
| WO | WO-0214781 A1 * | 2/2002 | | F42B 10/48 |
| WO | 2022229593 A1 | 11/2022 | | |

OTHER PUBLICATIONS

Extended European Search Report for European Patent Application No. 24150260.8, dated May 3, 2024, nine pages.

(Continued)

*Primary Examiner* — Justin M Benedik
(74) *Attorney, Agent, or Firm* — Kinney & Lange, P.A.

(57) ABSTRACT

A system can include a spinning structure configured to spin in operation, and at least one mass operatively connected to spinning structure to rotate about a spin axis with the spinning structure. The at least one mass can be configured to be moved relative to the spinning structure during a spin of the spinning structure. The system can include an actuation system configured to move the at least one mass relative to the spinning structure. The actuation system can be configured to move the at least one mass while the spinning structure is spinning to use the spin of the spinning structure to induce a precession torque on the spinning structure. The actuation system can be configured to synchronize actuation motion of the at least one mass to the spin of the spinning structure such that the induced precession torque is in a desired direction.

20 Claims, 18 Drawing Sheets

(56) References Cited

U.S. PATENT DOCUMENTS

| | | | | |
|---|---|---|---|---|
| 11,230,375 | B1 | 1/2022 | Hoffberg | |
| 2012/0211590 | A1* | 8/2012 | Mccool | F42B 10/26 244/3.21 |

OTHER PUBLICATIONS

Darpa Program—EXtreme ACcuracy Tasked Ordnance (EXACTO) demonstrated in-flight guidance of .50-caliber bullets. Program ended in 2015.

Ron Barrett, Ryan Barnhart, Richard Bramlette "Steerable Adaptive Bullet (StAB) piezoelectric flight control system" SPIE: Smart Structures and Materials + Nondestructive Evaluation and Health Monitoring 27 Mar. 27, 2012.

Flight mechanics of a novel guided spin-stabilized projectile concept, School of Aerospace Engineering, Georgia Institute of Technology, Atlanta, Georgia, USA, U.S. Army Research Laboratory, Aberdeen Proving Ground, Maryland, USA, Proceedings of the Institution of Mechanical Engineers, Part G: Journal of Aerospace Engineering 226.3 (2012): 327-340.

Jilei Liu and Chao Chen 2020 J. Phys.: Conf. Ser. 1507 102008 "Design of retractile fins actuator based on hollow piezoelectric motor" The 2020 Spring International Conference on Defence Technology, Journal of Physics: Conference Series/.

* cited by examiner

Illustration of the spin-scan modulation process.

Conical scanning concept. The radar beam is rotated in a small circle around the "boresight" axis, which is pointed at the target.

High Spin Speed at launch - Less Fin Pitch

Low Spin Speed - More Fin Pitch

| Description | Figure | Area moment of inertia | Comment |
|---|---|---|---|
| a filled circular area of radius r |   | $I_0 = \frac{\pi}{4} r^4$ | |
| an annulus of inner radius $r_1$ and outer radius $r_2$ |   | $I_0 = \frac{\pi}{4}\left(r_2^4 - r_1^4\right)$ | For thin tubes, this is approximately equal to: $\pi\left(\frac{r_2 + r_1}{2}\right)^3 (r_2 - r_1)$ or $\pi r^3 t$ |

HIGH SPEED ACTUATION SYSTEMS

FIELD

This disclosure relates to actuation systems, e.g., for projectiles and other applications.

BACKGROUND

Steering a projectile spinning at 10 Hz to 5000 Hz, for example, is traditionally done by de-spinning the projectile or part of the projectile to input a desired steering command. This increases complexity and decreases range and reliability. Traditional systems use various small control surfaces that are on partially or fully de-spun portions of the projectile and interact with the surrounding air flow to affect course changes.

Such conventional methods and systems have generally been considered satisfactory for their intended purpose. However, there is still a need in the art for improvements. The present disclosure provides a solution for this need.

SUMMARY

A system can include a spinning structure configured to spin in operation, and at least one mass operatively connected to the spinning structure to rotate about a spin axis with the spinning structure. The at least one mass can be configured to be moved relative to the spinning structure during a spin of the spinning structure. The system can include an actuation system configured to move the at least one mass relative to the spinning structure. The actuation system can be configured to move the at least one mass while the spinning structure is spinning to use the spin of the spinning structure to induce a precession torque on the spinning structure. The actuation system can be configured to synchronize actuation motion of at least one mass to the spin of the spinning structure such that the induced precession torque is in a desired direction.

The system can include a spring connecting the at least one mass to the spinning structure. In certain embodiments, the spring can have a natural frequency that is selected to match a frequency of the spin.

In certain embodiments, the at least one mass can be offset from the spin axis by a distance. In certain embodiments, the at least one mass can be configured to be actuated axially. In certain embodiments, the at least one mass can be configured to be actuated radially.

The actuation system can include at least one piezoelectric actuator operatively connected to the at least one mass to move the at least one mass. Any other suitable actuator that can operate at or above a speed of the spin is contemplated herein.

The spinning structure can be or include an aerodynamic body. The at least one mass can be disposed within the aerodynamic body.

The precession torque can change an angle of attack of the aerodynamic body in flight to produce an aerodynamic effect to modify a flight path of the aerodynamic body. In certain embodiments, the aerodynamic body can be a projectile or can be a portion of a projectile.

The at least one mass can be or can include a payload of the projectile. For example, in certain embodiments, the payload can be a warhead.

The actuation system can include a controller configured to determine a timing and amplitude to move the at least one mass as a function of a rotation angle of the spinning structure. The controller can be configured to output a command to cause motion of the at least one mass such that the at least one mass is phased and/or timed with the rotation angle of the projectile to induce an internal torque to correct a projectile flight toward a desired direction.

In certain embodiments, the controller can be configured to output the command once for each revolution of the spinning structure to cause actuation of the at least one mass once for each revolution of the spinning structure. In certain embodiments, the controller can be configured to output the command once per multiple revolutions of the spinning structure to cause actuation of the at least one mass once per multiple revolutions of the spinning structure to reduce energy consumption.

In certain embodiments, the spin can have a frequency greater than 10 Hz (e.g., up to about 5000 Hz). The system can be configured to operate with any suitable spin rate, and certainly including extremely high spin rates (e.g., for guided munitions).

In certain embodiments, the controller can be configured to receive rotational position information and/or location information. The controller can be configured to determine the command as a function of the received rotational position information and/or location information to cause a motion of the mass that results in a desired movement of the spinning structure.

In accordance with at least one aspect of this disclosure, a projectile can include a spinning structure, e.g., as described above, configured to spin in flight. The projectile can include at least one mass and an actuation system, e.g., as described above, to steer the projectile.

In accordance with at least one aspect of this disclosure, a non-transitory computer readable medium can include computer executable instructions configured to cause a computer to perform a method. The method can include receiving or determining a rotation angle and/or rate of spin of at least one mass attached to a spinning structure, determining a timing and amplitude to move the at least one mass as a function of the rotation angle and/or rate of spin to induce a precession torque on the spinning structure to steer the spinning structure in a desired direction, and outputting a command to an actuator to move the at least one mass. In certain embodiments, outputting the command can include outputting a command to cause motion of the at least one mass such that the at least one mass is phased and/or timed with the rotation angle of the spinning structure to correct a flight path of the spinning structure toward a desired location.

These and other features of the embodiments of the subject disclosure will become more readily apparent to those skilled in the art from the following detailed description taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, embodiments thereof will be described in detail herein below with reference to certain figures, wherein.

DETAILED DESCRIPTION

Figure 1:
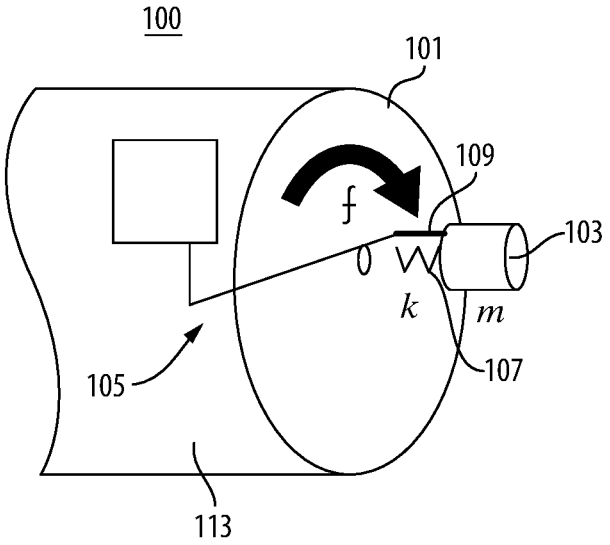
FIG. 1 is a schematic diagram of an embodiment of a system in accordance with this disclosure.

Reference will now be made to the drawings wherein like reference numerals identify similar structural features or aspects of the subject disclosure. For purposes of explanation and illustration, and not limitation, an illustrative view of an embodiment of a system in accordance with the disclosure is shown in FIG. 1 and is designated generally by reference character 100. Other embodiments and/or aspects of this disclosure are shown in FIGS. 2-18. Certain embodiments described herein can be used to control an orientation of a device (e.g., for orientation control, for aerodynamic steering, for stability, or other suitable purpose).

Figure 2:
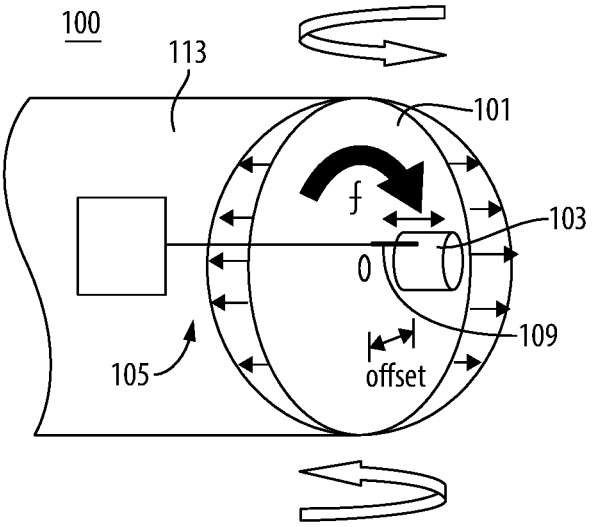
FIG. 2 is a schematic diagram of the embodiment of FIG. 1, schematically illustrating timing mass movement to rotation angle to produce a torque.
Figure 3:
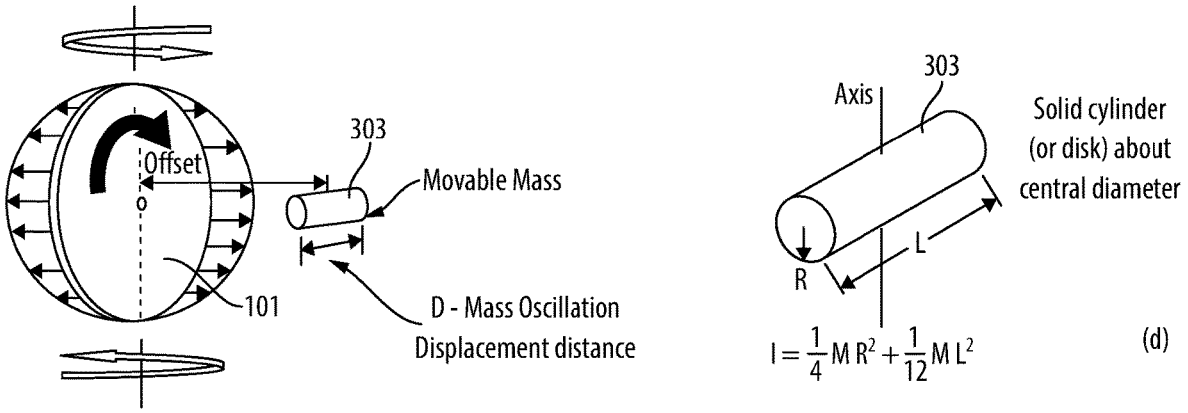
FIG. 3 is a schematic diagram an embodiment of a system in accordance with this disclosure.

Referring to FIGS. 1 and 2, a system 100 can include a spinning structure 101 configured to spin in operation, and at least one mass 103 operatively connected to spinning structure 101 to rotate about (e.g., offset from or concentrically) a spin axis (e.g., a center axis) with the spinning structure 101. The at least one mass 103 can be configured to be moved relative to the spinning structure 101 during a spin of the spinning structure 101.

The system 100 can include an actuation system 105 configured to move the at least one mass relative to the spinning structure 101. The actuation system 105 can be configured to move the at least one mass 103 while the spinning structure 101 is spinning to use the spin of the spinning structure 101 to induce a precession torque on the spinning structure 101. The actuation system 105 can be configured to be synchronize the actuation motion of (e.g., timing the actuation motion of) the at least one mass 103 to the spin of the spinning structure 101 such that the induced precession torque is in a desired direction (e.g., to change the orientation of the spinning structure 101 and/or associated structure and/or housing in a desired way). For example, the actuation system 105 can be configured to actuate a mass 103 in a first direction once per rotational period in the same location to effect a force in the same direction. In certain embodiments, the actuation system 105 can be configured to actuate the mass 103 in a reverse direction 180 degrees away, once per period. Any suitable number of masses 103 is contemplated herein, e.g., one as shown, two placed symmetrically and operated in reverse, three placed symmetrically, etc.).

The system 100 can include a spring 107 connecting the at least one mass 103 to the spinning structure 101. In certain embodiments where there are multiple masses 103, each mass 103 can be associated with an individual spring, or with a common spring in combination with any other mass(es) 103. In certain embodiments, the spring can have a natural frequency that is selected to match a frequency of the spin (e.g., a designed spin rate of the spinning body 101).

In certain embodiments, as shown in FIGS. 1 and 2, the at least one mass 103 can be offset from the spin axis by a distance. In certain embodiments, the at least one mass 103 can be configured to be actuated axially, e.g., as shown in FIGS. 1 and 2. In certain embodiments, referring additionally to FIG. 3, the at least one mass 303 can be configured to be actuated radially (which may affect the spin rate and require spin rate compensation). The mass 101, 303 can include any suitable shape (e.g., a cylinder as shown, as disk, etc.). The effect of motion of any mass based on its location, shape, size, and/or the spin rate of the spinning structure 101 can be determined by one having ordinary skill in the art without undue experimentation.

Figure 4:
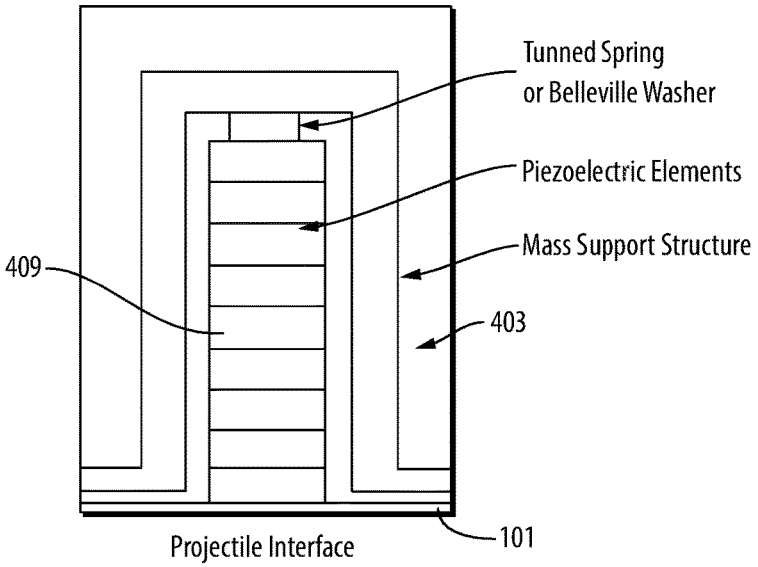
FIG. 4 is a schematic diagram of an embodiment of a piezoelectric actuator in accordance with this disclosure.

The actuation system 105 can include an actuator 109 configured to move the at least one mass 103. Referring additionally to FIG. 4, in certain embodiments, the actuator 109 can be or include at least one piezoelectric actuator 409 operatively connected to the at least one mass 403 to move the at least one mass 403 (e.g., a payload). The piezoelectric actuator 409 can include a plurality of elements which can be hollow and internally stacked, for example. The mass 403 can be a payload of a projectile for example, and the piezoelectric actuator 409 can be connected to a front bulkhead of the projectile. Any suitable springs can be added to the assembly, e.g., as disclosed herein (e.g., a tuned spring and/or Bellville washer as shown). Any other suitable actuator 109 that can operate at or above a speed of the spin is contemplated herein.

Figure 5:
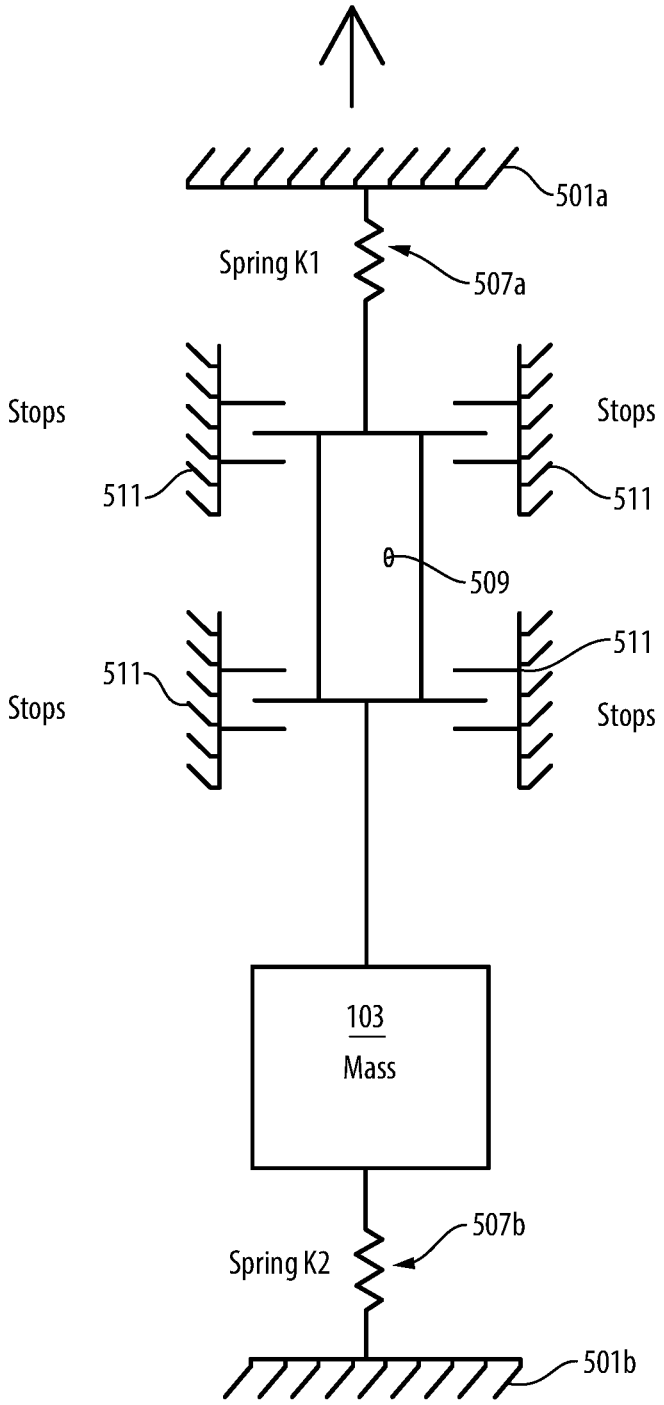
FIG. 5 is a schematic diagram of an embodiment of a piezoelectric actuator in accordance with this disclosure.
Figure 6:
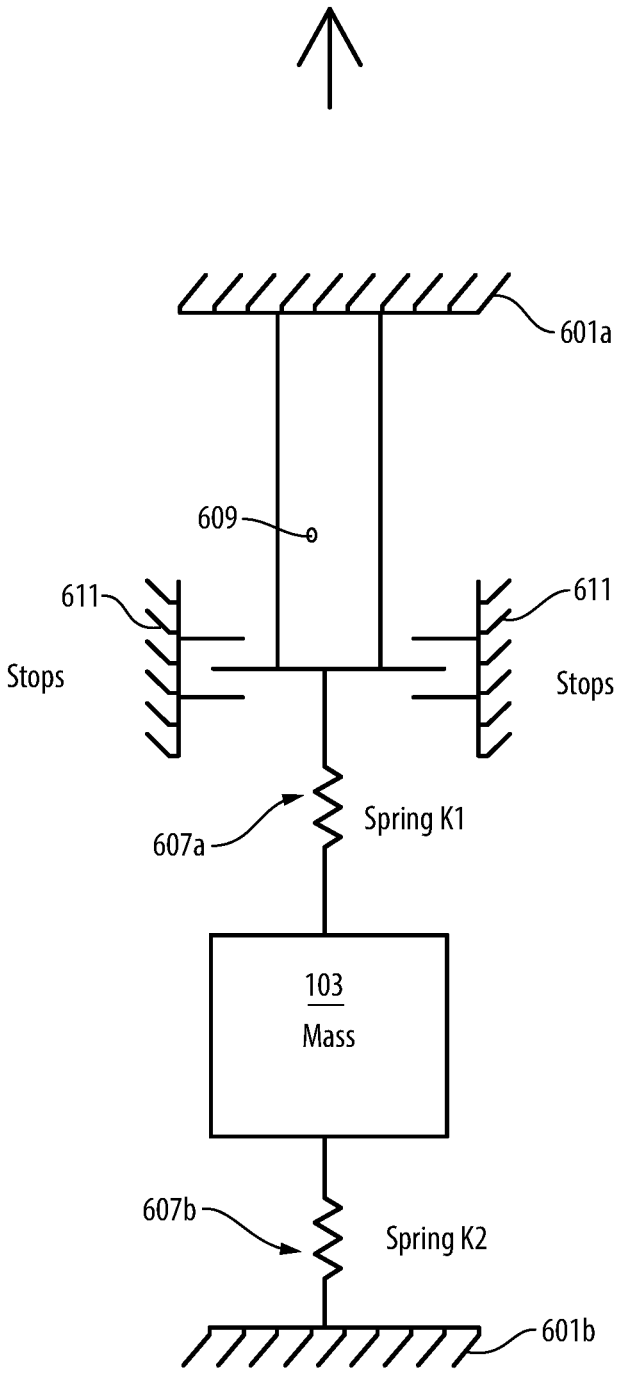
FIG. 6 is a schematic diagram of an embodiment of a piezoelectric actuator in accordance with this disclosure.

As shown in FIGS. 5 and 6, an actuator 509, 609 can be mounted between two portions 501*a*, 501*b*, 601*a*, 601*b* of a spinning structure. As shown, the actuators 509, 609 can be configured to be stopped by stops 511, 611 to limit motion of the actuators 509, 609, and the mass 103, for example. The actuators 509, 609 and/or the mass 103, separately or collectively, can be mounted at both sides by a spring 507*a*, 507*b*, 607*a*, 607*b*. Any other suitable arrangement is contemplated herein.

The spinning structure 101 can be or include an aerodynamic body 113. The at least one mass 103 can be disposed within the aerodynamic body 113, e.g., as shown in FIGS. 1 and 2.

The precession torque can change an angle of attack of the aerodynamic body 113 in flight to produce an aerodynamic effect (e.g., a cross-wind effect) to modify a flight path of the aerodynamic body 113. In certain embodiments, the aerodynamic body 113 can be a projectile (e.g., a missile, a bullet) or can be a portion of a projectile (e.g., a spinning portion of a missile with fins).

The at least one mass 103 can be or can include a payload 403 (e.g., as shown in FIG. 4) of the projectile. For example, in certain embodiments, the payload 403 can be a warhead.

The actuation system 105 can include a controller 115 configured to determine a timing and amplitude to move the at least one mass 103 as a function of a rotation angle of the spinning structure 101. The controller 115 can be configured to output a command to cause motion of the at least one mass 103 such that the at least one mass 103 is phased and/or timed with the rotation angle of the projectile to induce an internal torque to correct a projectile flight toward a desired direction.

In certain embodiments, the controller 115 can be configured to output the command once for each revolution of the spinning structure 101 to cause actuation of the at least one mass 103 once for each revolution of the spinning structure 101. In certain embodiments, the controller 115 can be configured to output the command once per multiple revolutions of the spinning structure 101 to cause actuation of the at least one mass 103 once per multiple revolutions of the spinning structure 101 to reduce energy consumption.

In certain embodiments, the spin can have a frequency greater than 10 Hz (e.g., up to about 5000 Hz). The system 100 can be configured to operate with any suitable spin rate, and certainly including extremely high spin rates (e.g., for guided munitions). Piezoelectric actuators, for example, have a very high response time that can operate at or above 5000 Hz, for example.

In certain embodiments, the controller 115 can be configured to receive rotational position information and/or location information (e.g., from an onboard navigation system, GPS, seeker reticles, or any other suitable source to determine angle of spin to coordinate motion of the mass 103 at the correct time/rotational angle to cause the desired steering effect). The controller 115 can be configured to determine the command as a function of the received rotational position information and/or location information to cause a motion of the mass 103 that results in a desired movement of the spinning structure 101.

In accordance with at least one aspect of this disclosure, a projectile (e.g., a missile, bomb, bullet, etc.) can include a spinning structure 101, e.g., as described above, configured to spin in flight. The projectile can include at least one mass 103 and an actuation system, e.g., as described above, to steer the projectile. Any other suitable application for the disclosed system 100 is contemplated herein (e.g., satellite orientation control, boat stability systems, etc.).

In accordance with at least one aspect of this disclosure, a non-transitory computer readable medium can include computer executable instructions configured to cause a computer to perform a method. The method can include receiving or determining a rotation angle and/or rate of spin of at least one mass 103 attached to a spinning structure 101, determining a timing and amplitude to move the at least one mass 103 as a function of the rotation angle and/or rate of spin to induce a precession torque on the spinning structure 101 to steer the spinning structure 101 in a desired direction, and outputting a command to an actuator to move the at least one mass 103. In certain embodiments, outputting the command can include outputting a command to cause motion of the at least one mass 103 such that the at least one mass 103 is phased and/or timed with the rotation angle of the spinning structure 101 to correct a flight path of the spinning structure 101 toward a desired location.

In accordance with certain embodiments, it is commonly desired for projectiles to spin at very high rates. However, this spinning presents a control challenge to aerodynamic controls as a response or control time is not sufficient to account for the speed of rotation of the projectile. Prior art attempts to create forces in traditional ways that require de-spinning of a projectile or portions thereof, or having a portion of the projectile that doesn't spin. Embodiments included in this disclosure, however, can control a projectile using the spin energy by moving a mass and creating a gyroscopic precession that tilts the projectile in flight. Embodiments can be used for weapons, vehicles, sports equipment (e.g. a football), or any other suitable spinning mass. Embodiments can have any suitable shape mass, can have a spring to return the mass, and/or can have two or more actuators opposing each other to have bidirectional control. In certain embodiments, actuators can move a valve instead of a mass, and then ram airflow can move the mass. The mass can be moved by any suitable mass movement system (e.g., mechanical, fluidic) to create a pseudo precession torque, e.g., in the pitch and yaw direction. Certain embodiments can also control roll speed with a radially moving mass. Piezoelectric actuators can enable such quick controls synchronized to rotational position of a spinning projectile, for example. In certain embodiments, e.g., as shown, the actuator can be part of the moving mass system and spring arrangement as shown.

In certain embodiments, embodiments can use GPS signals to aid in determining rotational position. Such projectiles can include asymmetric antenna location, which information can be used to enhance the roll angle information. Certain embodiments can include asymmetric antennas and symmetric antennas to have both varying amplitude of signal to determine roll, as well as continuous amplitude signal to have continuous GPS position info. Any other suitable roll sensor is contemplated herein (e.g., an on board magnetometer, optical sensor, IMU, etc). Multiple systems for determining roll position can allow correction of IMU-type cumulative error, e.g., with GPS, for example.

Embodiments of a mass can be configured for axial movement because radial movement will change rotation speed with movement. However, this effect can also be used and has certain benefits (e.g., to control wobble).

Embodiments can include a solid-state piezoelectric actuation system for rotating projectiles. Embodiments can allow low-cost steerable projectiles. Embodiments can provide the accuracy of a smart, precise steerable projectile at the cost of a dumb projectile. Embodiments can include a spinning projectile high bandwidth, solid state piezoelectric steering system capable of developing high speed synchronous steering torques on a projectile. These induced torques change the angle of attack of the projectile as it moves through the air, allowing in-flight corrections, whereas traditional systems rely on complicated de-spinning portions of the projectile.

Embodiments can include piezoelectric solid-state element(s) driving a mass system inside the projectile to create a pseudo-precession torque. Piezoelectric materials can have significant advantages over electromagnetic, magnet, solenoid, and other types of drive methods. Piezoelectric drives can be more compact and efficient at high operating speeds and can work under preloaded conditions.

Movement of an offset mass synchronized to the rotation angle of the projectile creates a synchronous torque. As the projectile rotation angle passes thorough 180 deg, the reaction force of the movable mass flips direction and can be repeated with each projectile revolution. A controller can determine the phase and amplitude of the mass movements based on target information.

Embodiments do not require projectile to be de-spun or require complicated bearings or other rotating elements. Embodiments are robust, have the high bandwidth, high speed, are lower cost to manufacture, and are easier to make gun launch capable. Embodiments can utilize known spin benefits whereas traditional systems try to take spin out of the control scheme.

partially or fully de-spun portions of the projectile and interact with the surrounding air flow to affect course changes. Embodiments instead can embrace the spin of the projectile, are capable of actuation speeds as high as the projectile spin speed, and can use the entire aerodynamic body of the projectile to affect course changes and not just small control surfaces. Embodiments of a projectile utilizing the disclosed system need not even include any active control surfaces at all, for example.

Piezoelectric solid-state element(s) driving a mass system inside the projectile create a pseudo-precession torque. This torque acts on the projectile and changes the projectile angle of attack relative to the airflow, changing the flight path equivalent to a cross wind on the projectile. At least one piezoelectric driven movable mass can be used. Additional masses can be added for symmetry, for example. The mass could be paired with a spring system that is selected to have a natural frequency that is matched/tuned to the spin rate of the projectile, e.g., in accordance with the below formula.

$$f = \frac{1}{2\pi}\sqrt{\frac{k}{m}}$$

The acceleration of a sinusoidal moving mass is calculated from by $A=2\pi^2$ f 2D, wherein f is spin and mass oscillation frequency, and wherein D is distance, the mass moves with each revolution.

Table 1 below shows spin speed vs acceleration, power required, torque generated, angular acceleration, and end over end rotations after 80 seconds. This is based on 1 Kg mass moving with 0.001 inches of displacement per projectile revolution with an offset of 1.5 inches. The rotation rate can be estimated to be acting on a 1 meter long 48 Kg cylinder.

TABLE 1

| Projectile Spin Speed Hz | "G" rms | Power (mW) | Torque N-M | Torque In-Oz | Angular Acc Radian/sec 2 | Radians After 80 sec | Complete Rotations After 80 sec |
|---|---|---|---|---|---|---|---|
| 100 | 0.361 | 0.649 | 0.014 | 1.950 | 0.003 | 11.016 | 1.753 |
| 200 | 1.446 | 5.192 | 0.055 | 7.800 | 0.014 | 44.065 | 7.014 |
| 300 | 3.253 | 17.524 | 0.124 | 17.551 | 0.031 | 99.147 | 15.781 |
| Mass (Kg) | 1 | | | | | | |
| Motion (.in) | 0.001 | | | | | | |
| Offset (.in) | 1.5 | | | | | | |
| 1 m 48 Kg Cylinder | | | | | | | |

Embodiments can be scalable to 50 caliber or smaller bullets, mortars, tanks, 155 howitzer rounds, or any other suitable projectile. Spin can be incorporated into the seeker or microwave radar, for example. Embodiments can work with or without GPS and/or an IMU and can manage coning. Embodiments can comprise a sealed projectile that reduces FOD risks.

Embodiments can include a spinning projectile solid state piezoelectric steering system capable of developing a synchronous steering torque on a projectile. This torque changes the angle of attack of the projectile as it moves through a fluid medium allowing for in-flight corrections.

Steering a projectile spinning at 10 Hz to 5000 Hz requires an actuation system that can respond at rates that are at least as fast as the projectile rotation speed, or requires some portion of the projectile to be de-spun, increasing complexity and decreasing range and reliability. Current fielded systems use various small control surfaces that are on A 0.001 in displacement is well within the possibility of current piezoelectric Lead Zirconium Titanate (PZT) technology, for example. The above noted power calculations do not consider any PZT or other inefficiencies. The above table illustrates that that using only 2% of the available mass with a single element moving 0.001 in leaves a considerable amount of margin to increase projectile torques on a final design based on required level of control authority.

In certain embodiments, a separate piezoelectric mass could be added to move in the radial axis to manage coning and other flight characteristics. The movable mass could be installed in the fuse well or contain a portion of a warhead, for example, assuming the explosive was stable. The movable mass could also include the batteries or be made from an inert material. Since only small displacements may be required, piezoelectric drivers can include quartz and or PZT. Piezoelectric materials can have significant advantages over electromagnetic, magnet and solenoid types of drive methods. Piezoelectric drives can be more compact and efficient at these operating speeds, work well under preloaded conditions, and do not produce large magnetic fields which can interfere with sense magnetometers used in the flight system. These piezoelectric injectors can survive hostile environments while meeting lifetime and reliability requirements.

If a projectile course correction is required, a controller can determine the necessary timing and amplitude required to move the mass relative to the rotation angle of the projectile. The mass movement can be phased or timed with the rotation angle of the projectile to induce an internal torque to correct the projectile flight toward the desired direction. If a small course correction is required, the controller would command the mass a shorter distance, but still at the correct phase angle relative to the projectile. A single command could be sent for each revolution. In some embodiments the controller could also monitor the mass position. For battery efficiency, the controller could take advantage of a possible resonant mass spring system described above and send a single command per several revolutions, for example.

Solving the actuation problem on a spinning platform opens new possibilities and capabilities for terminal guidance. The projectile spin enables use of recital seeker technology or radar/transmitter receiver conical scanning without having to use a separate motor, for example.

Figure 7:
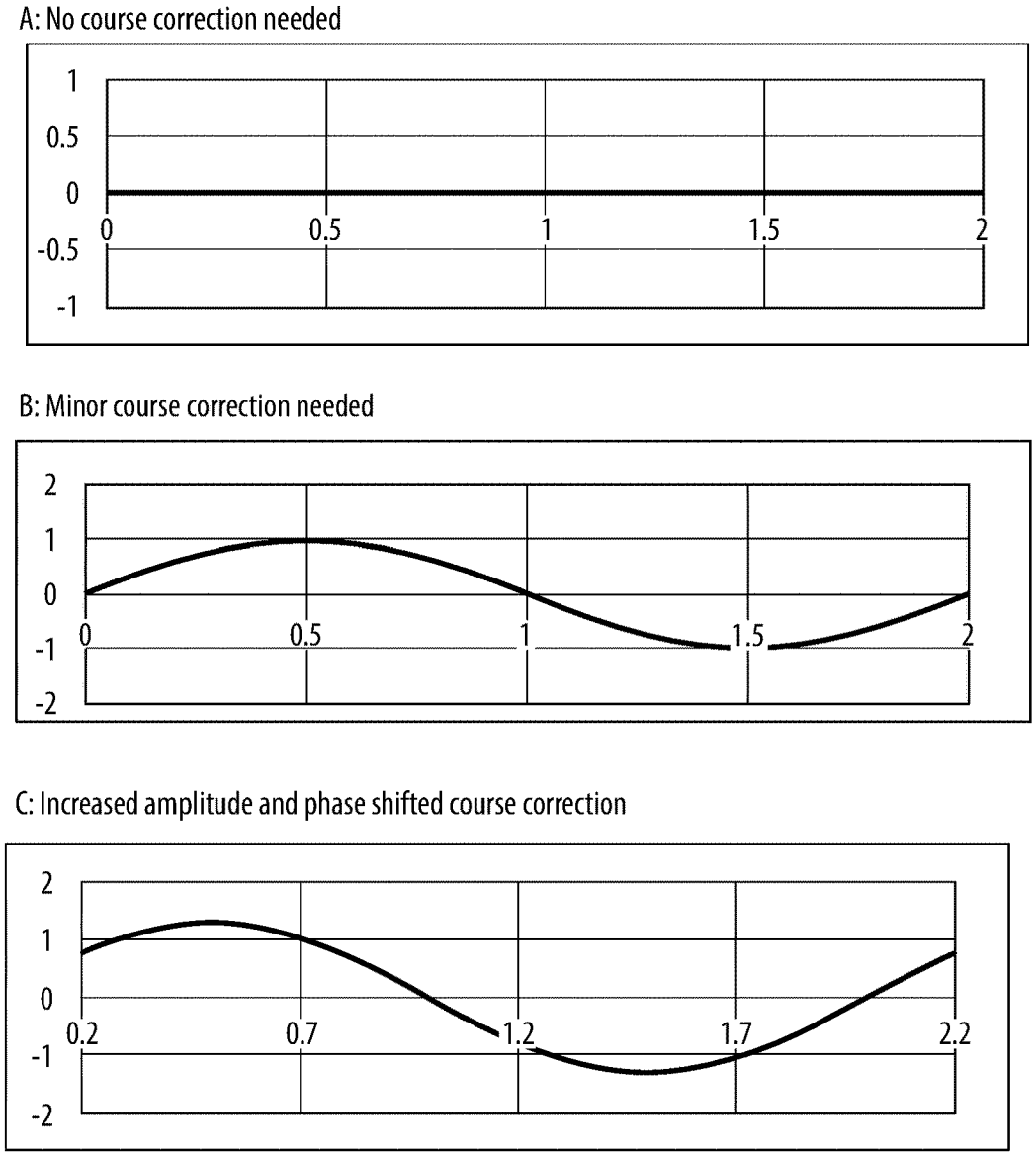
FIG. 7 is a schematic diagram of an embodiment of a reticle seeker and associated command inputs for an actuator attached to a mass related to target locations A, B, and C, wherein amplitude is driven by pulse height based on target location in seeker field of view.
Figure 7:
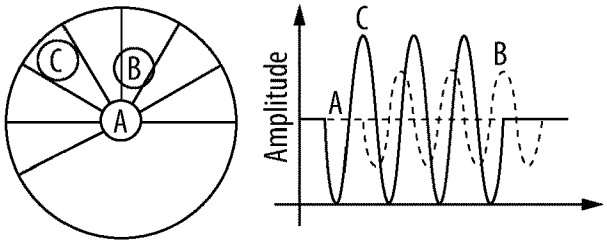
Figure 8:
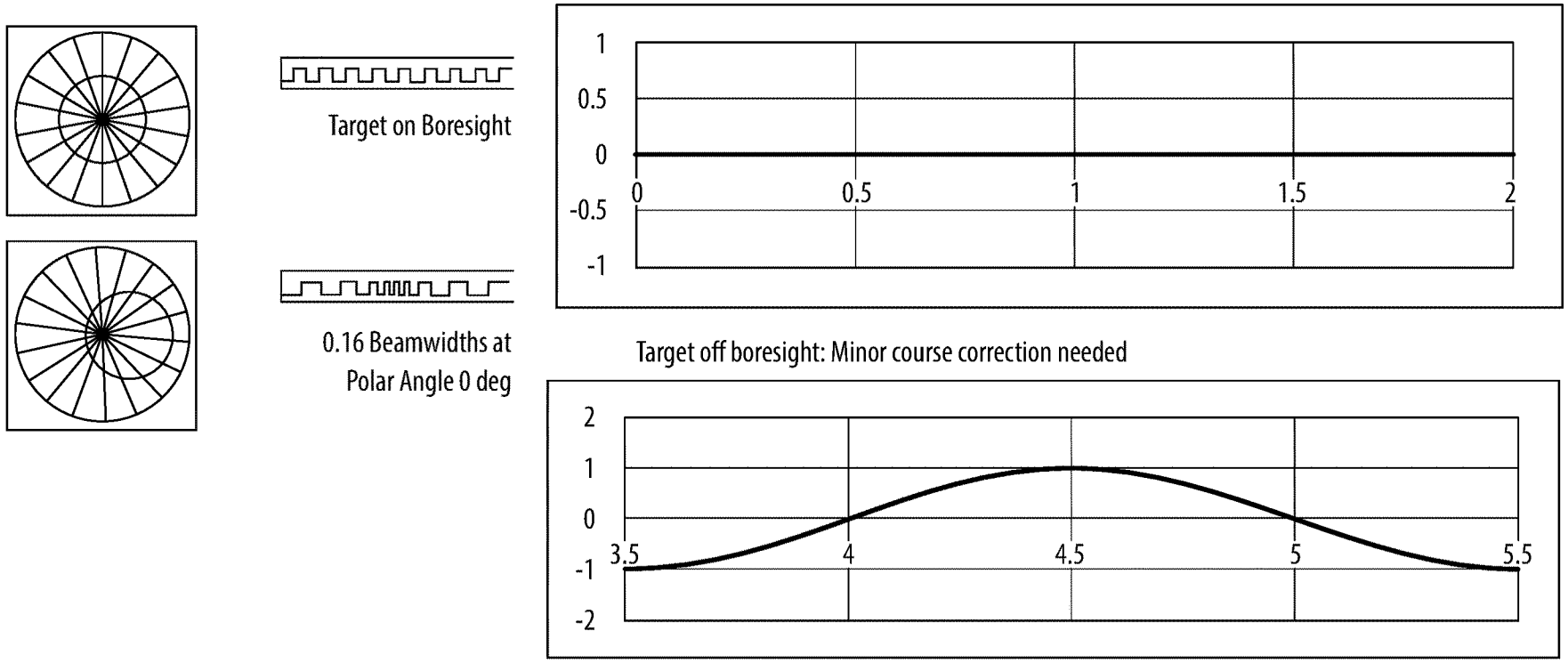
FIG. 8 is a schematic diagram of an embodiment of a pulse width modulated (PWM) reticle seeker and associated command inputs for an actuator attached to a mass for target locations on boresight, and off boresight, wherein amplitude is driven by pulse width.
Figure 9:
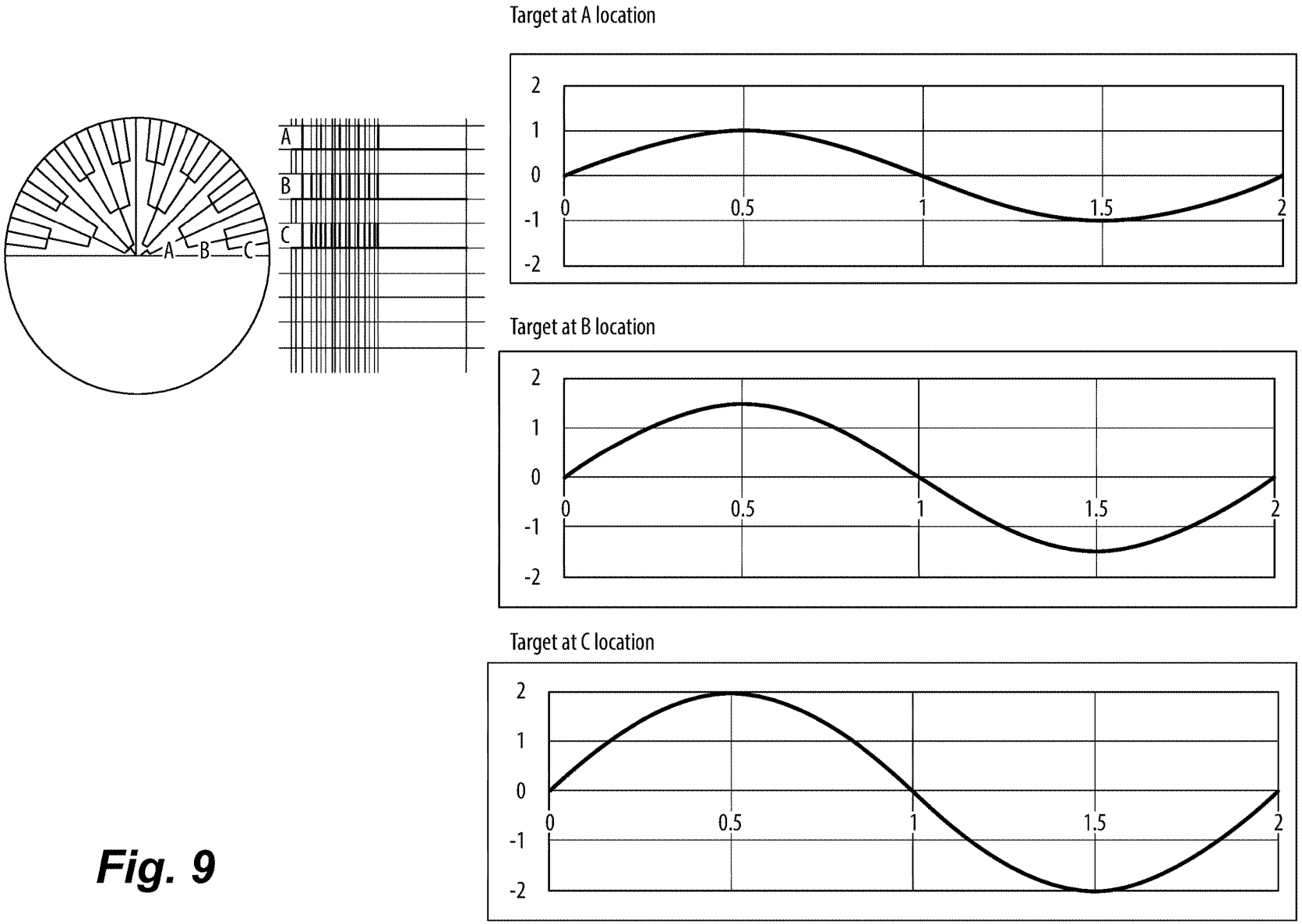
FIG. 9 is a schematic diagram of an embodiment of a frequency modulated (FM) reticle seeker and associated command inputs for an actuator attached to a mass for target locations A, B, and C on the reticle, wherein amplitude is driven by number of pulses.
Figure 10A:
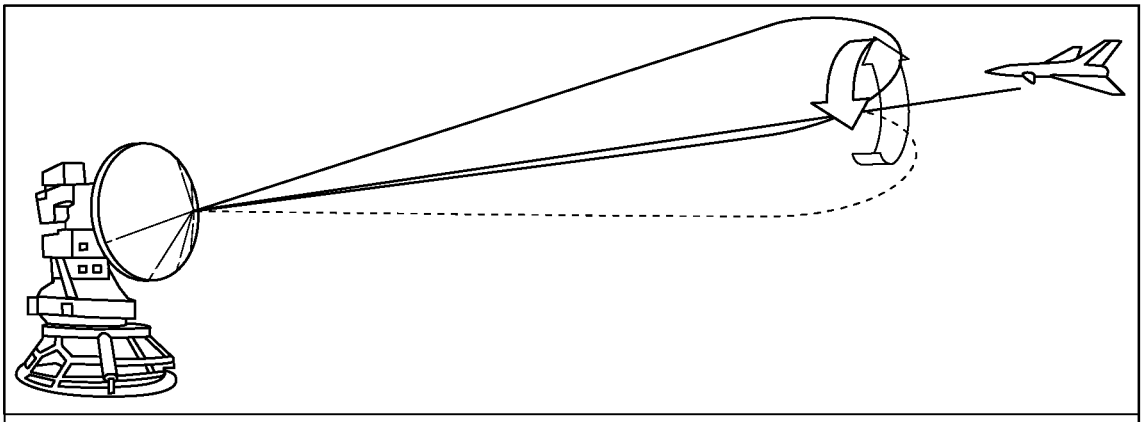
FIG. 10A schematically shows a conical scanning concept, wherein a radar beam is rotated in a small circle around the boresight axis pointed at the target.
Figure 10B:
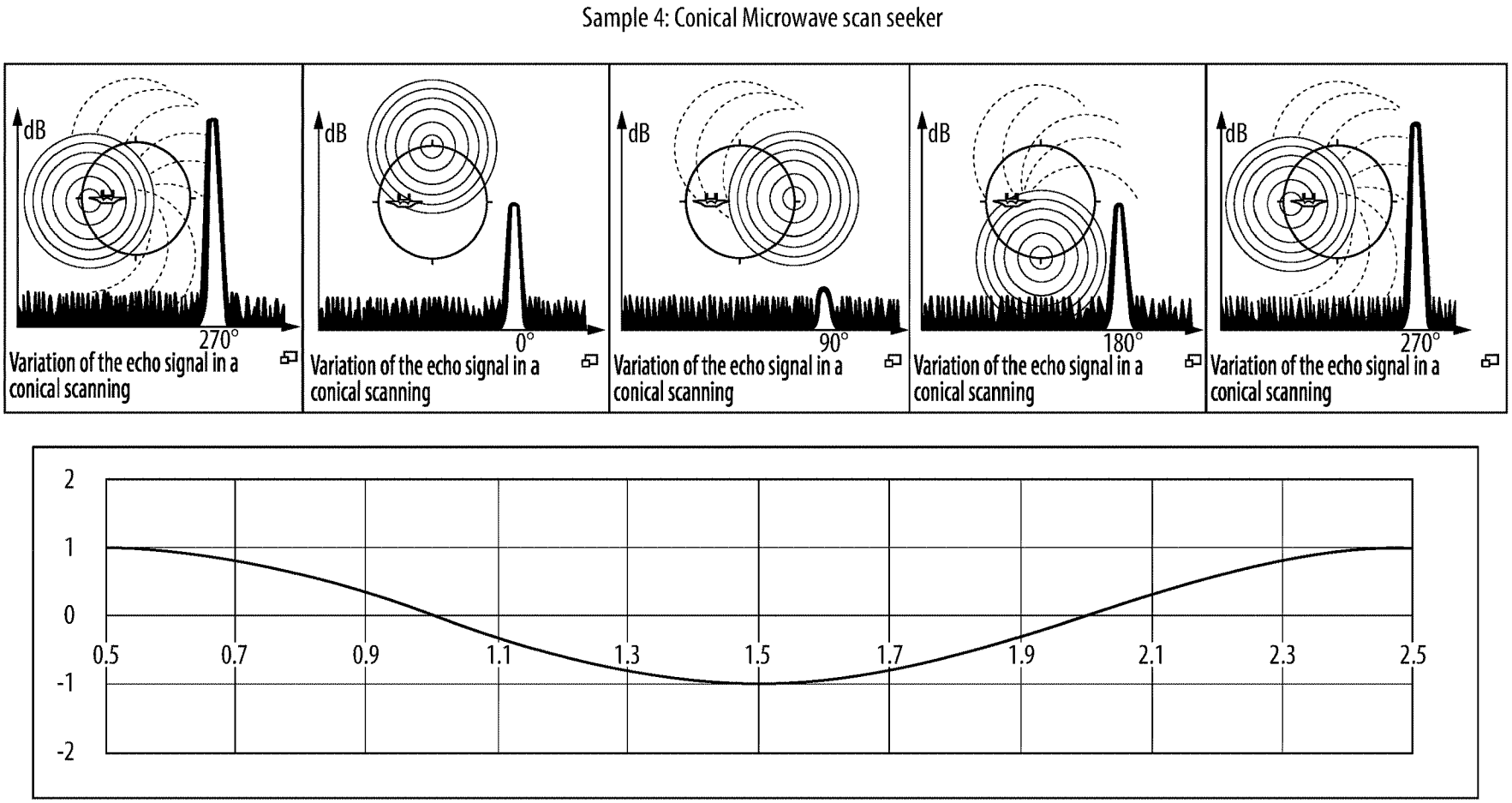
FIG. 10B is a schematic diagram of an embodiment of a conical microwave scan seeker and associated command inputs for an actuator attached to a mass for target locations as shown relative to a circle reticle.
Figure 11:
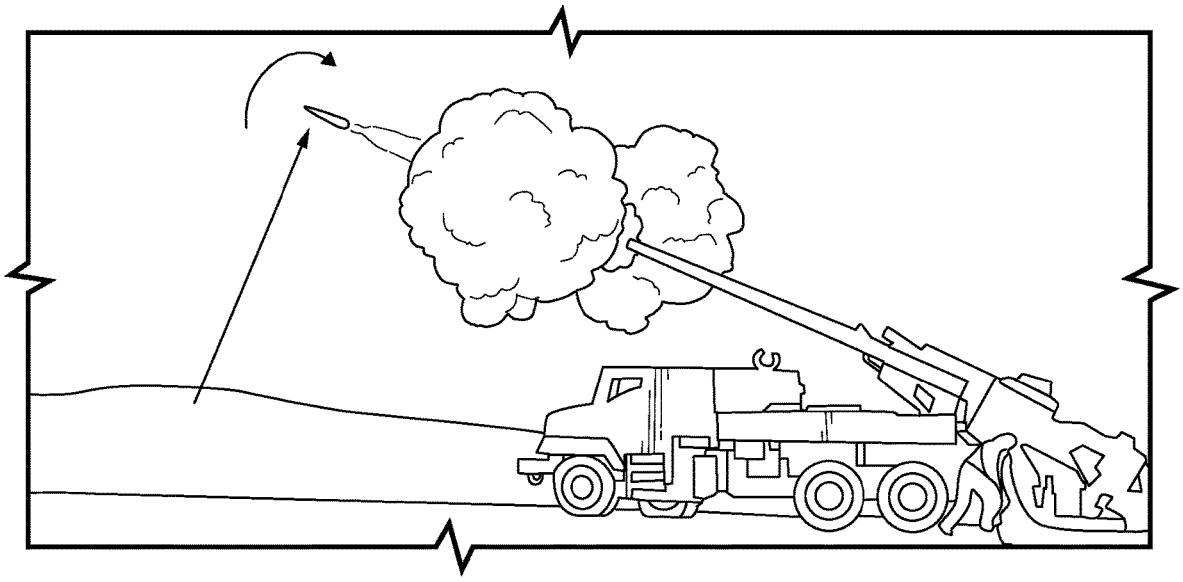
FIG. 11 illustrates an embodiment of a system including an optical horizon sensor, ambient light sensor, or magnetometer identifying phase reference signal.
Figure 12:
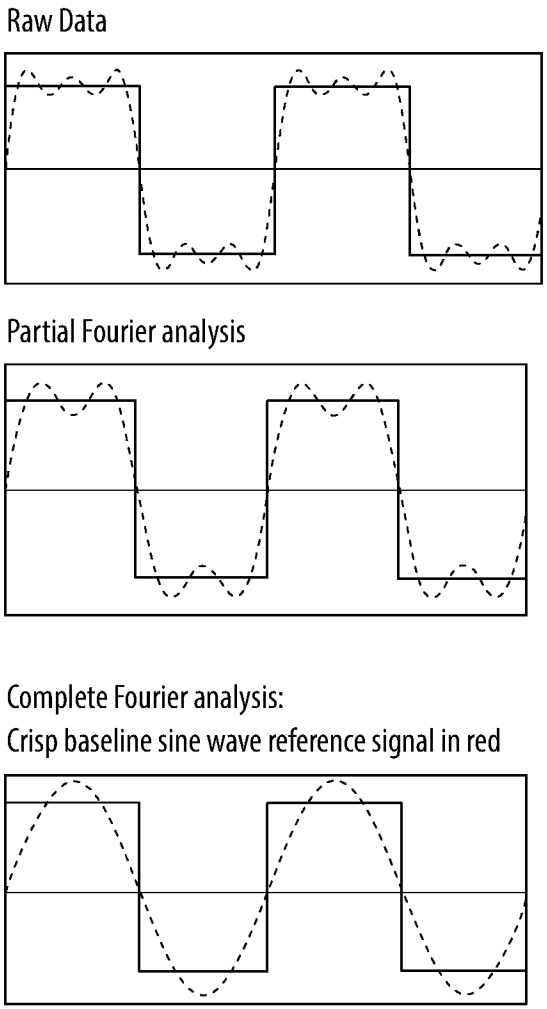
FIG. 12 illustrates an embodiment of a system including an imaging system and a base line reference movable mass position signal that can be phase shifted and/or modified based on GPS or other inputs.
Figure 12:
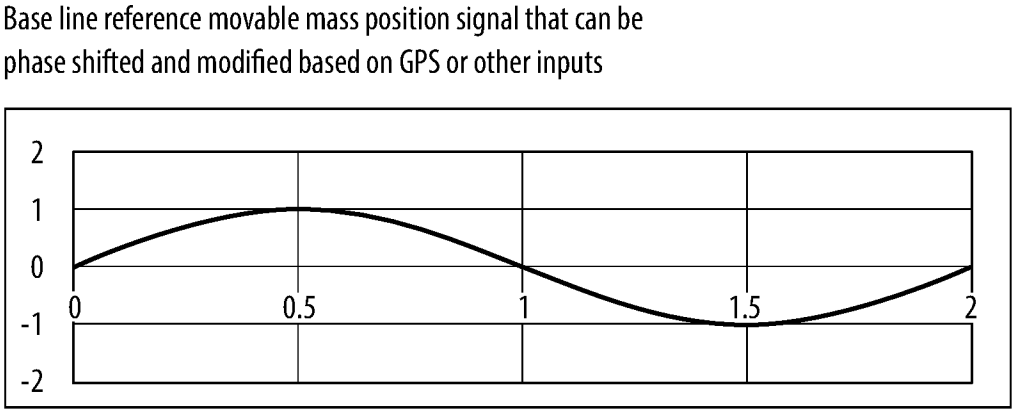
Figure 13:
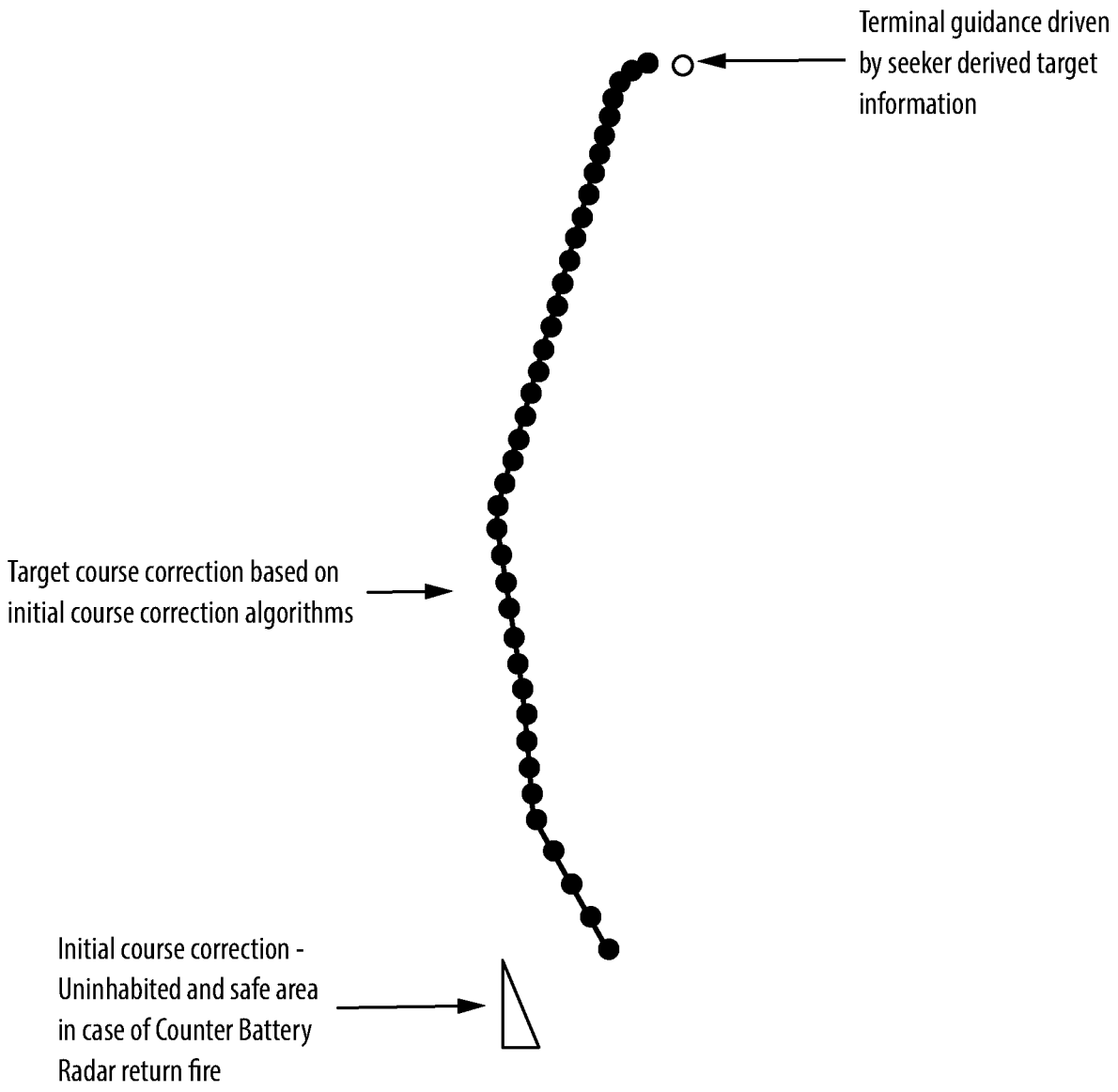
FIG. 13 illustrates an embodiment of a projectile course in accordance with this disclosure.

FIG. 7 is a schematic diagram of an embodiment of a reticle seeker and associated command inputs for an actuator attached to a mass related to target locations A, B, and C, wherein amplitude is driven by pulse height based on target location in seeker field of view. FIG. 8 is a schematic diagram of an embodiment of a pulse width modulated (PWM) reticle seeker and associated command inputs for an actuator attached to a mass for target locations on boresight, and off boresight, wherein amplitude is driven by pulse width. FIG. 9 is a schematic diagram of an embodiment of a frequency modulated (FM) reticle seeker and associated command inputs for an actuator attached to a mass for target locations A, B, and C on the reticle, wherein amplitude is driven by number of pulses. FIG. 10A schematically shows a conical scanning concept, wherein a radar beam is rotated in a small circle around the boresight axis pointed at the target. FIG. 10B is a schematic diagram of an embodiment of a conical microwave scan seeker and associated command inputs for an actuator attached to a mass for target locations as shown relative to a circle reticle. FIG. 11 illustrates an embodiment of a system including an optical horizon sensor, ambient light sensor, or magnetometer identifying phase reference signal. FIG. 12 illustrates an embodiment of a system including an imaging system and a base line reference movable mass position signal that can be phase shifted and/or modified based on GPS or other inputs. FIG. 13 illustrates an embodiment of a projectile course in accordance with this disclosure.

An example includes a Semi Active Laser (SAL) guided projectile that would detect the pulsed laser designator/illuminator energy reflected from the target. The energy would go through a standard reticle or specialized reticle with no masking in the center. The light would then go through optical filters to eliminate unwanted energy and then onto to the laser detector. The controller would verify that the laser energy and intended signal are both correctly encoded. Since the reticle can be fixed to the spinning projectile, a separate motor to spin a mirror is not required. Based on the type of reticle, the controller would calculate the magnitude and needed correction angle and send the needed command signals to the piezoelectric driven movable mass(es). A special reticle seeker can be unmasked in the center, telling the controller the projectile does not need to change course. To increase the field of view in flight, the controller can initiate a projectile coning maneuver to scan a larger target area and then return to a non-coning flight.

Another example can include an anti-aircraft projectile designed to target a warm object against a cold sky that can be configured with a reticle seeker and a thermal detector capable of rapid cooling. The thermal energy from the target would go through a standard reticle or specialized reticle and optical filters to eliminate unwanted energy and make the desired energy available to the thermal detector, as shown in FIGS. 8 and 9. The controller can then calculate the magnitude and needed correction angle and send the needed command signals to the piezoelectric driven movable mass(es).

Another example can include an alternate anti-aircraft seeker that can detect light being blocked by the aircraft. Such embodiments can be implemented with a Focal Plane Array that is digitally de-spun. In such an approach, the seeker would not be distracted by flares or other thermal decoys.

Another example can include an alternate anti-aircraft projectile having an off-bore axis microwave radar emitter and a bore site receiver that can be used to detect an aircraft and provide the controller angle and phase angle information between the target and projectile. The spin of the projectile can provide a built-in conical scan pattern, eliminating the need for a separate scan motor, e.g., as shown in FIG. 10A. This embodiment can be an upgrade and replacement to a standard radio proximity fuse. This embodiment can provide steering commands to the projectile for terminal guidance. Time of arrival information can provide range information. The peak signal information can be used by the controller to steer the projectile toward the target in the center or null region of the microwave scan, e.g., as shown in FIG. 10B.

Another example can include a projectile that uses the Global Positioning System (GPS) for overall guidance, and the projectile can be aided by an additional external rotation angle reference. The external rotation reference signal could be from changes in signal strength or signal amplitude from individual GPS satellites, a magnetometer measuring the earth's magnetic field, optical horizon sensor, ambient light sensor, inertial sensor, or a combination of sensors and methods listed, or other, e.g., as shown in FIG. 11. After launch, the GPS system can keep track of the projectile flight path as well as the external reference information gathered with each revolution. This can allow the projectile to establish a link and relationship between the GPS information and the external reference. The projectile could then initiate a small course change, using the reference data for timing while monitoring GPS positions. After this initial sequence, the flight controller can strengthen the link between the external reference and the GPS information. The controller can continue to calculate and refine the link and relationship with every course correction and projectile revolution all the way to the final target.

Projectiles that use thermal, microwave or SAL based seekers could also benefit from using above-described external rotation referenced signals to aid the controller.

In embodiments, a repetitive movable mass position signal can be generated by the controller. For example, as shown in the reticle seeker of FIG. 7, amplitude is driven by pulse height based on the target location in seeker field of view. In FIG. 8, amplitude is driven by pulse width. In FIG. 9, amplitude is driven by number of pulses (e.g., 90 degrees shifted from FIG. 8).

In FIG. 10, peaks on echo scans align with controller signal used to steer projectile. The difference in peak-to-peak echo signal, vs projectile roll angle reflects how far the target is from the boresight, for example. In FIGS. 11 and 12, horizon or side looking imaginings system can be used. Wavy lines reflect raw data from horizon or side looking imaginings systems, and a width of the lower line vs width of the upper line provide an estimate of altitude. The singular line is a base line reference movable mass position signal that can be phase shifted and modified based on GPS or other inputs.

Methods to estimate projectile roll angle can be blended with GPS. Integrating GPS into a spinning projectile can include estimating projectile roll angle. For example, individual GPS satellite change in signal strength per revolution can be used. Signal of opportunity change in signal strength per revolution from TV, cell tower, navigation transmission, or other systems can be used. Magnetometers that sense the Earth's magnetic field can estimate/measure projectile roll and a portion of the pitch angle. This method is accurate and repeatable but may not apply when flying parallel to the Earth's magnetic field. Projectile pitch can also be estimated by time of flight information. An imaging system can be digitally de-spun to estimate projectile roll and some portion of pitch angle. Any other suitable system is contemplated herein.

Using a history of GPS position coordinates enables the projectile to estimate pitch and yaw, adding terminal guidance driven by seeker derived target information. Knowing the projectile roll angle, current GPS projectile location, previous GPS locations and desired flight path enables the controller to calculate the needed projectile course corrections.

To establish projectile roll angle and calculate course solutions, the controller can use Fourier analysis, Kalman-Bucy-Stratonovich Filter, Particle Filter, Phase Lock Loop or other similar approaches. Various projectile intercept paths including Classical Pursuit, Proportional Navigation, Constant Bearing Decreasing Range (CBDR), Real-Point Motion Camouflage or Infinity-Point Motion Camouflage can be included in the controller guidance algorithms. Changing the projectile pitch angle can also be used to increase lift and extend and adjust the range of the projectile.

Figure 14A:
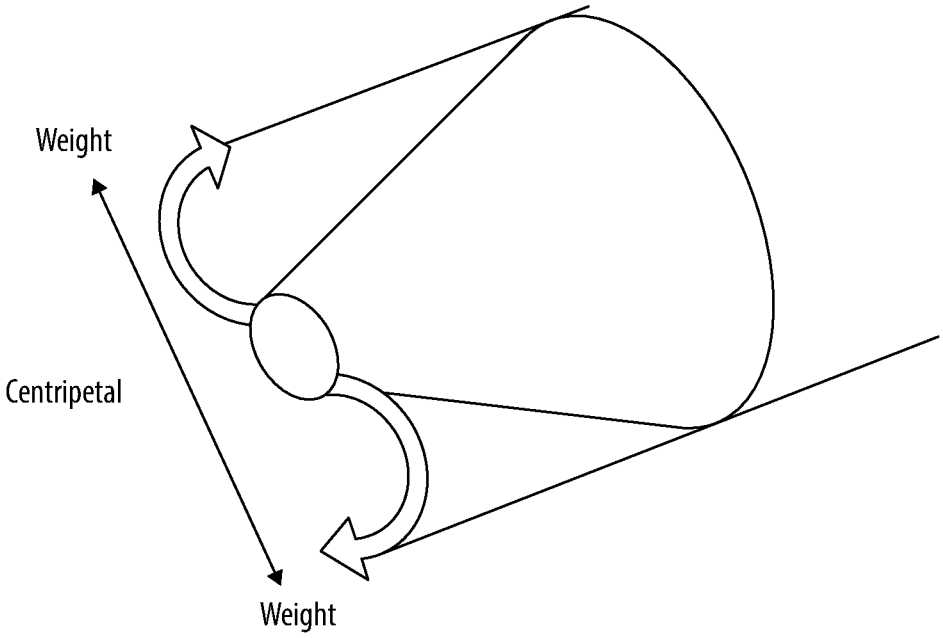
FIG. 14A is a schematic diagram of an embodiment of a constant speed mechanism for a projectile configured to cause a projectile to maintain a constant rotational speed, shown having moveable fins in a lower pitch state accounting for higher spin speed.
Figure 14B:
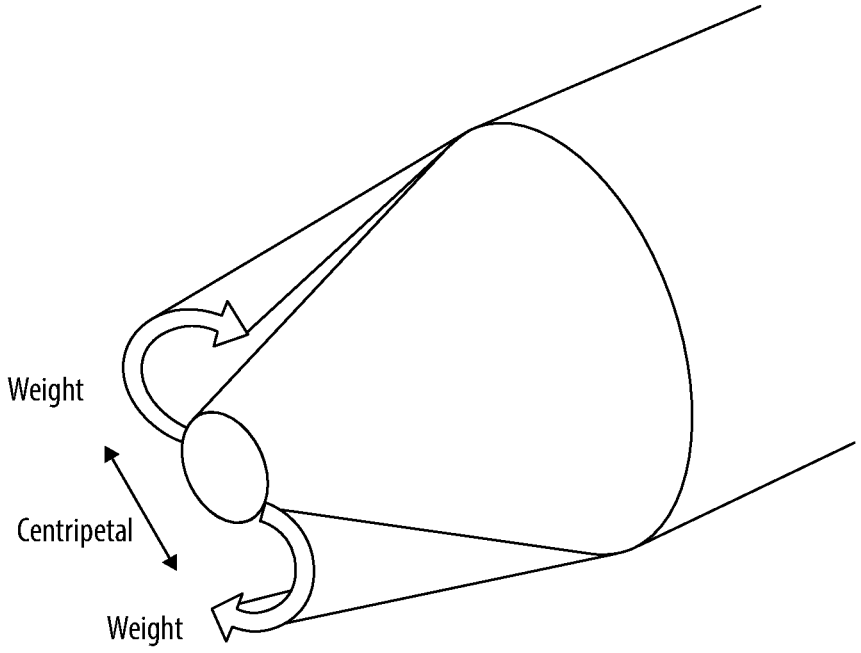
FIG. 14B is a schematic diagram of the embodiment of FIG. 14A, shown having moveable fins in a higher pitch state accounting for a lower spin speed.

Referring to FIGS. 14A and 14B, to keep the projectile at a constant spin speed, curved spring-loaded fins with mass can be added to a projectile (e.g., a tail). As the spin speed of the projectile decays, the centripetal force on the illustrated mass is reduced. This allows the fins to curve in, creating a larger fin angle of attack with the airflow, keeping the projectile spin speed constant throughout the flight to enhance moving mass resonance. For example, embodiments can include tail fins that bend, e.g., as shown in FIGS. 14A and 14B. These can be used to keep spin speed constant and can comprise passive/spring loaded fins that regulate spin speed. Maintaining a constant speed can aid in calculations and control using certain embodiments of this disclosure.

Figure 15:
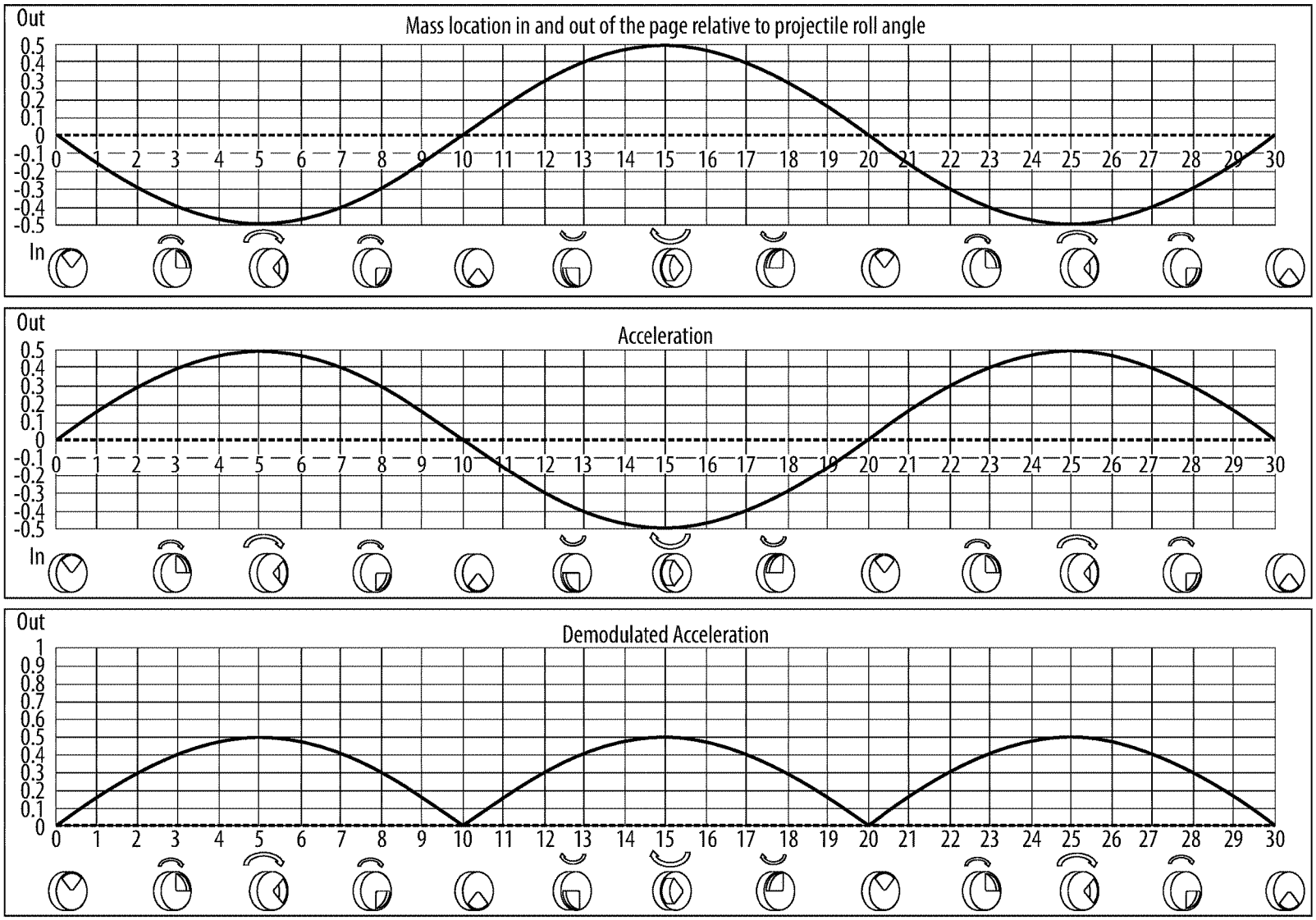
FIG. 15 illustrates a phase diagram showing how rotation of a projectile flips (e.g., with a pie shaped moveable mass) a reaction force polarity, showing that the curved arrows above each cross section are showing torque in the same direction.

FIG. 15 illustrates a phase diagram showing how rotation of a projectile flips (e.g., with a pie shaped moveable mass) a reaction force polarity, showing that the curved arrows above each cross section are showing torque in the same direction. FIG. 15 shows a pie piece shaped mass that is moved axially (e.g., in the flight direction). Any number or shape of masses are contemplated. Multiple masses can be moved together (e.g., opposite directions when opposite sides to produce double the procession).

Figure 16:
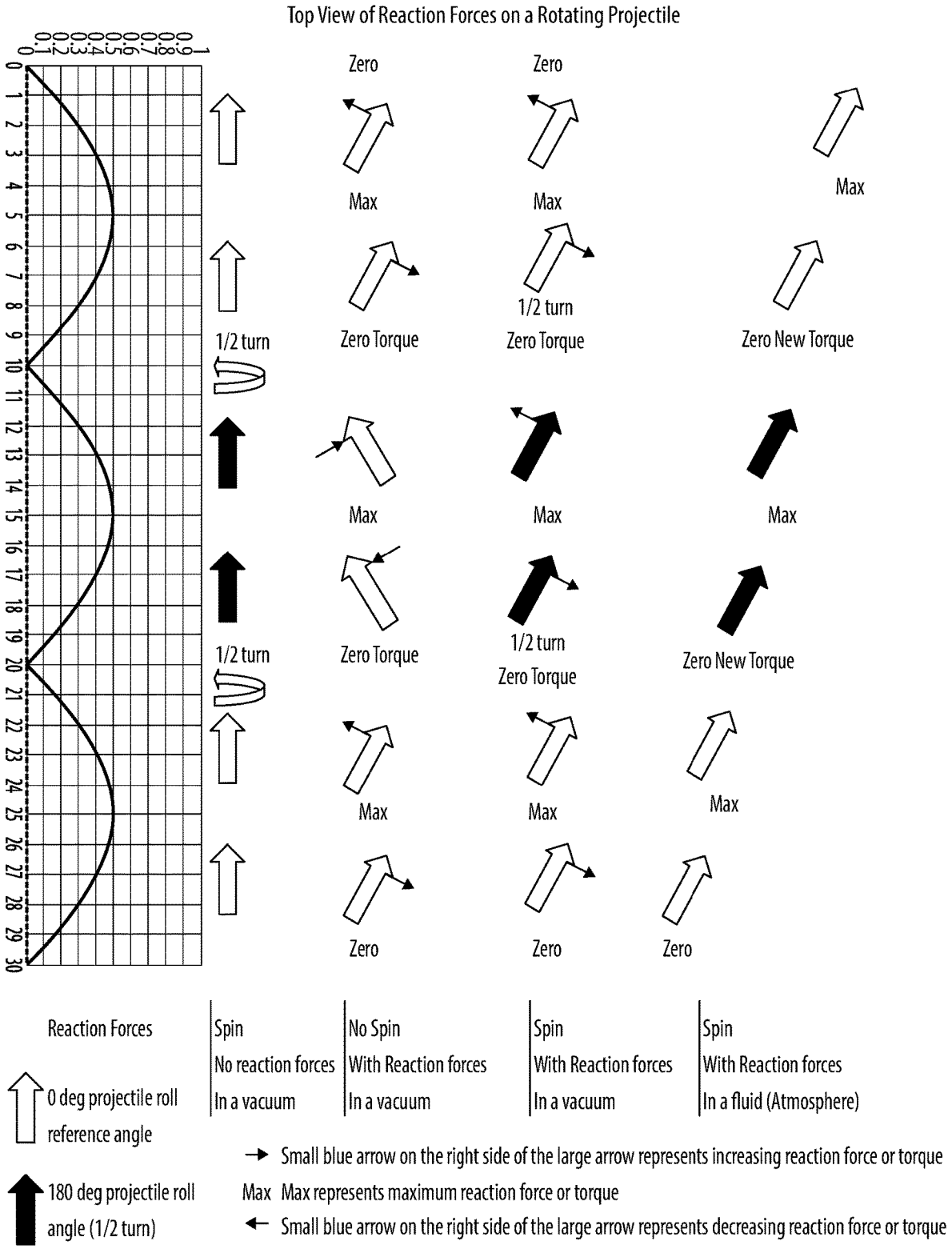
FIG. 16 illustrates the effect of no control in a vacuum versus control in a vacuum and in fluid, wherein projectile steering is shown when in a fluid.

FIG. 16 illustrates the effect of no control in a vacuum versus control in a vacuum and in fluid, wherein projectile steering is shown when in a fluid. Small arrows on the left side of the large arrow represent decreasing reaction forces or torque, while small arrows on the right side of the large arrows represent increasing reaction force or torque. Max represents maximum reaction force or torque. Adding additional movable weights 90 degrees from the initial movable weight can smoothen out the reaction forces and torques, for example.

Figure 17:
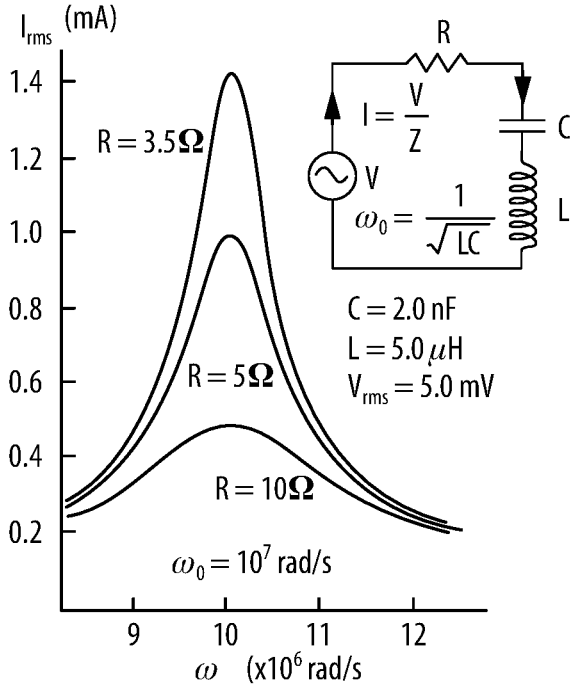
FIG. 17 illustrates an embodiment of a series and parallel electrical resonant circuit in accordance with this disclosure, wherein capacitors and inductors can capture energy generated by the piezoelectric element during compression which can be returned to the piezoelectric element on the next cycle.
Figure 17:
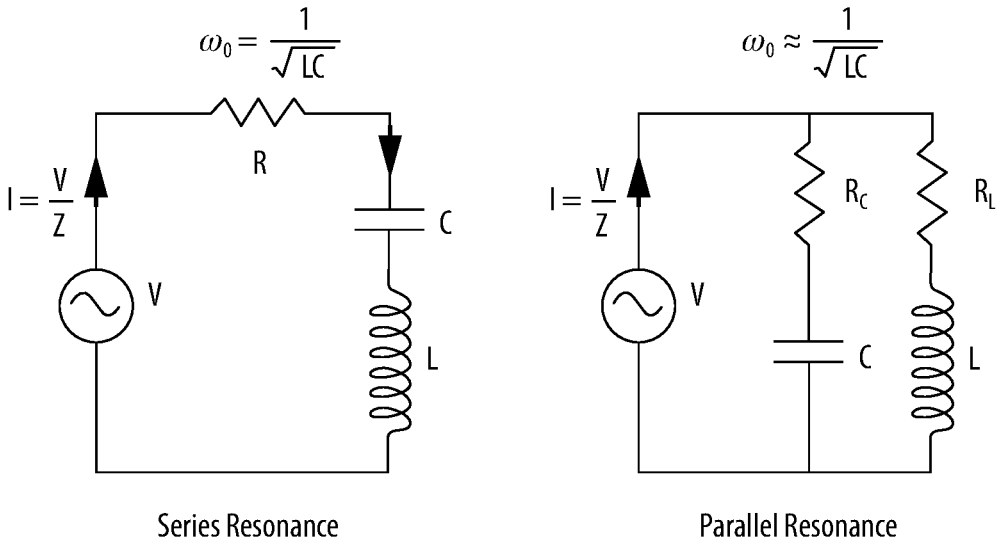

FIG. 17 illustrates an embodiment of a series and parallel electrical resonant circuit in accordance with this disclosure. The capacitors and inductors can capture energy generated by the piezoelectric element during compression which can be returned to the piezoelectric element on the next cycle. Acoustic vibratory motion of a mass or synchronized acoustic vibratory mass (rotational spin speed or synchronized mass movement speed is in the acoustic range 20 Hz to 5000 Hz) can be utilized. In addition to a mechanical resonant circuit, electrical resonant circuit can be included in the design. Capacitors and inductors can capture energy generated by the piezoelectric element during compression. That energy can be returned to the piezoelectric element on the next cycle. As shown in FIG. 17, wo is projectile rotation speed.

Figure 18:
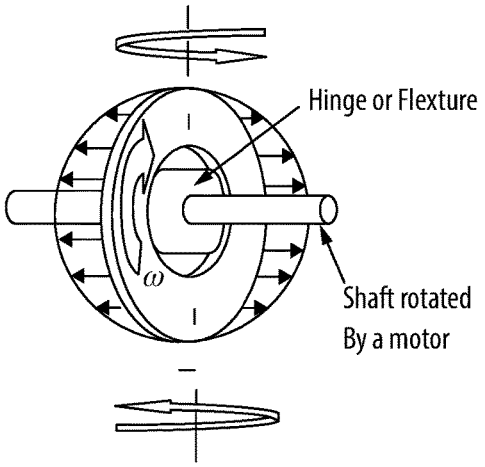
FIG. 18 is a schematic diagram of an embodiment of a system in accordance with this disclosure.
Figure 18:
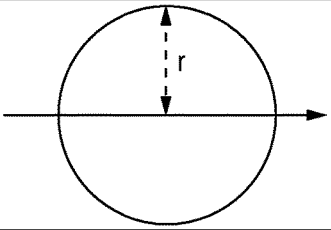
Figure 18:
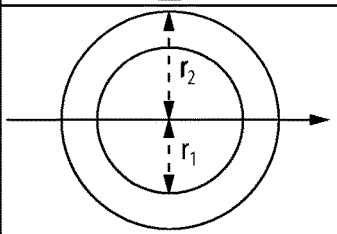
Figure 18:
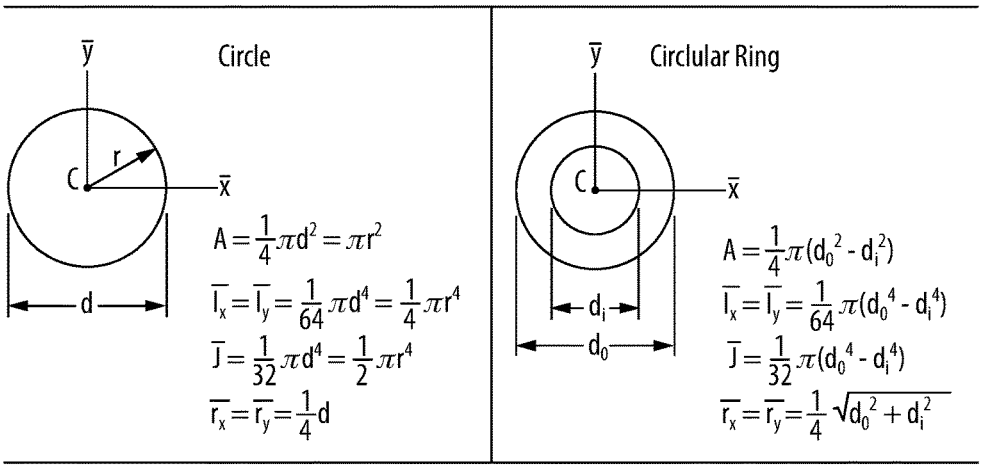

FIG. 18 is a schematic diagram of an embodiment of a system in accordance with this disclosure. For example, the system in FIG. 18 can have a shaft rotated by a motor and a hinge or flexure at the center. This can be used in a satellite pointing, sensor pointing, imaging systems pointing, projectile steering or boat stabilization and pointing systems for example.

Certain embodiments can require balancing the projectile Center of Gravity (CG) with the Center of Pressure (CP) to optimize stability vs control authority.

Embodiments do not require the projectile to be de-spun and fully utilize the known benefits of a spinning projectile. Embodiments do not require complicated bearings or other rotating elements. Embodiments can be simple, high bandwidth, fast responding, robust, and low cost to manufacture, and can be significantly easier to make gun launch capable. The approach is scalable and could be applied to any spinning application, e.g., a spirally thrown football, 50 caliber or smaller bullet, mortar round, tank round, 155 howitzer round, 2.75/70 mm, or larger rolling airframe missiles, rotating hypersonic projectile or reentry vehicle, for example.

Embodiments require minimal to no modification to the device firing or launching the missile or projectile. Certain embodiments can even reduce the need for a slip-band/Obturators on the projectile.

Typically, high spin speed steering requires high actuation speeds, which does not allow significant actuator displacement. The small actuator displacements into the airflow can keep the control actuator motion in the boundary layer of the projectile and limit the change in course of the projectile. The piezoelectric moving mass approach can use the whole body of the projectile for flight control, for example.

The spin of the projectile can be incorporated into the seeker or microwave radar, eliminating the need for separate motor driven scanning-mirrors or antennas, requiring fewer parts, and reducing complexity. Eliminating the complicated seeker or microwave radar spin structures allows the seeker or microwave radar to be more robust and survive gun fired shocks including setback and balloting, along with high spin accelerations.

Embodiments can provide a method to manage coning. To increase seeker scan field of view, coning can be induced. For managing projectile range, coning could be modified in-flight, for example.

Spinning the projectile allows the projectile to take advantage of well understood ballistic properties, reducing the need for an IMU. Since control actuation can be done inside the projectile, the projectile can remain sealed. This would eliminate the possibility for battlefield dirt, debris, residue from the gun power or moisture to accumulate inside the projectile. In non-sealed projectiles, critical gaps and complicated precision mechanical structures can become jammed and be subject to Foreign Object Damage (FOD).

Embodiments do not require actuators to unfold in one axis and change angles in a separate axis. Embodiments can work with or without GPS or Inertial Measurement Unit (IMU) aiding.

In certain embodiments, the movable mass(es) can be in a vacuum or in an air cavity that reinforces the resonance as part of the spring system. Movable mass(es) can be mechanically coupled. The controller can manage the phase and amplitude of the signal to the piezoelectric element. Embodiments can include a cross axis moving mass to generate a torque.

The offset distance of the mass can be larger, increasing torque. Keeping the center of the movable mass on the projectile centerline can provide certain advantages, but is not required. Moving a cross axis mass will induce projectile spin rate variations due to conservation of angular momentum.

Embodiments can be used with any seeker. Certain seekers could also include a drop in background energy or lack of UV i.e., shadow in the sky. Certain embodiments can use a drop in background energy to derive position information. Certain embodiments can use an air valve concept instead of piezo to move the mass. Embodiments can provide anti-UAV solutions.

The disclosed approach is seeker agnostic. Seekers can also include rotation conical microwave transmitter/receiver. Embodiments can provide possible two frequencies for a wide and narrow field of view. An upgraded fuse or proximity airburst round can steer the projectile into the target. Certain embodiments can use piezoelectric valves for a lower energy solution, e.g., possibly for small caliber round. A synchronized piezoelectric air valve can open, allowing air to move the mass. The piezoelectric valve can open and close and the mass can be returned to original position by a spring or air.

Embodiments can be used for boat stabilization/anti roll systems. The developed precession torque can be used to minimize the boat roll in a smaller and simpler, sealed, package than gimbaled systems. Using moving elements on a spinning wheel with the spin axis running from the Port side to the Starboard side, across the beam, would allow restoring torques to be applied to the boat in more compact package. This implementation could be done with 4 pie shaped masses attached to the shaft via a hinge. Actuators can move the entire ¼ mass synchronously to spin wheel position. This approach would take up less overall space and could and be easier to implement than the current systems. During the wheel spin up and spin down, a constant but small torque would be applied along the boat pitch axis.

Embodiments can be used for satellites. Adding synchronized moving mass element(s) to a reaction wheel gyroscope spinning element can provide two axes of control moment gyroscope (CMG) capability in a simplified and significantly smaller package, possibly making this capability available for smaller satellites.

Embodiments can be used for camera angular vibration reduction. Adding spinning wheel synchronized moving mass elements to a camera pointing system can allow angular vibration to be removed. This implementation for higher end systems can use air or gas bearings.

Satellite pointing, camera/sensor/instrument stabilization or boat stability systems can require torque generation in two axes. For applications like satellite pointing, camera stabilization or boat stability systems that require torque generation in two axes, the entire inertial wheel or segments of the wheel can tilt on a hinge or flexure relative to the shaft axis. The wheel tilting can be synchronized to the wheel rotation angle/position. A third axis of torque can be generated by speeding up or slowing down the same wheel. Referring to FIG. 18, at a predetermined shaft spin speed w, the torsional flexure stiffness k, can be matched to the mass via $\omega=\text{sqrt}(k/m)$ (radians/second) where m=I or wheel moment of inertia.

On a non-spinning vehicle, structures, or platform, a motor spun mass can have one or more movable mass elements or mass elements that are mounted on a hinge or flexure that can generate two axes of torque on the host vehicle or portions of the host vehicle, structure or platform. The out-of-plane movement of the movable mass can be synchronized to the rotation angle of the rotating elements, making them capable of generating two separate axes of torque. Mechanical stops on the rotating elements can limit the out-of-plane range of motion. A third axis of torque can be generated by speeding up or slowing down the same overall spinning mass. For example, this can be used in satellite pointing, sensor pointing, imaging systems pointing, projectile steering or boat stabilization and pointing systems.

In certain embodiments, to keep the projectile at a constant spin speed, curved spring-loaded fins with mass can be added to a projectile (e.g., a tail). As the spin speed of the projectile decays, the centripetal force on the illustrated mass is reduced. This allows the fins to curve in, creating a larger fin angle of attack with the airflow, keeping the projectile spin speed constant throughout the flight, enhancing and keeping internal moving mass resonance more constant.

In certain embodiments, actuators can move a valve open and close instead of directly moving a mass, and outside ram airflow moves the mass that is synchronized to the rotation angle of the projectile. High speed valves can open and close allowing the mass to return in a synchronized manner, based on the rotation angle, to an original position by a spring or ram airflow.

Embodiments can include any suitable computer hardware and/or software module(s) to perform any suitable function (e.g., as disclosed herein). For example, the controller 115 can include any suitable computer hardware and/or software.

As will be appreciated by those skilled in the art, aspects of the present disclosure may be embodied as a system, method or computer program product. Accordingly, aspects of this disclosure may take the form of an entirely hardware embodiment, an entirely software embodiment (including firmware, resident software, micro-code, etc.), or an embodiment combining software and hardware aspects, all possibilities of which can be referred to herein as a "circuit," "module," or "system." A "circuit," "module," or "system"

can include one or more portions of one or more separate physical hardware and/or software components that can together perform the disclosed function of the "circuit," "module," or "system", or a "circuit," "module," or "system" can be a single self-contained unit (e.g., of hardware and/or software). Furthermore, aspects of this disclosure may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of this disclosure may be written in any combination of one or more programming languages, including an object-oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

Aspects of this disclosure may be described above with reference to flowchart illustrations and/or block diagrams of methods, apparatus (systems) and computer program products according to embodiments of this disclosure. It will be understood that each block of any flowchart illustrations and/or block diagrams, and combinations of blocks in any flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in any flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified herein.

Those having ordinary skill in the art understand that any numerical values disclosed herein can be exact values or can be values within a range. Further, any terms of approximation (e.g., "about", "approximately", "around") used in this disclosure can mean the stated value within a range. For example, in certain embodiments, the range can be within (plus or minus) 20%, or within 10%, or within 5%, or within 2%, or within any other suitable percentage or number as appreciated by those having ordinary skill in the art (e.g., for known tolerance limits or error ranges).

The articles "a", "an", and "the" as used herein and in the appended claims are used herein to refer to one or to more than one (i.e., to at least one) of the grammatical object of the article unless the context clearly indicates otherwise. By way of example, "an element" means one element or more than one element.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e., "one or the other but not both") when preceded by terms of exclusivity, such as "either," "one of," "only one of," or "exactly one of."

Any suitable combination(s) of any disclosed embodiments and/or any suitable portion(s) thereof are contemplated herein as appreciated by those having ordinary skill in the art in view of this disclosure.

The embodiments of the present disclosure, as described above and shown in the drawings, provide for improvement in the art to which they pertain. While the subject disclosure includes reference to certain embodiments, those skilled in the art will readily appreciate that changes and/or modifications may be made thereto without departing from the spirit and scope of the subject disclosure.

What is claimed is:

1. A system, comprising:

a spinning structure configured to spin in operation;

a mass operatively connected to the spinning structure, the mass configured to rotate with the spinning structure about a spin axis of the spinning structure, wherein the mass is configured to be moved relative to the spinning structure during a spin of the spinning structure; and an actuation system configured to move the mass relative to the spinning structure, wherein the actuation system is further configured to control movement of the mass and to synchronize the movement of the mass to a rotation angle of the spinning structure, thereby inducing a synchronous precession torque to the spinning structure in a desired direction.

2. The system of claim 1, further comprising a spring connecting the mass to the spinning structure.

3. The system of claim 2, wherein a natural frequency of the spring and the mass is selected to match a frequency of the spin.

4. The system of claim 1, wherein the mass is offset from the spin axis by a distance.

5. The system of claim 4, wherein the mass is configured to be moved axially with respect to the spinning structure.

6. The system of claim 4, wherein the mass is configured to be moved radially with respect to the spinning structure.

7. The system of claim 1, wherein the actuation system includes a piezoelectric actuator operatively connected to the mass to move the mass.

8. The system of claim 1, wherein the spinning structure is or includes an aerodynamic body, wherein the mass is disposed within the aerodynamic body.

9. The system of claim 8, wherein the precession torque changes an angle of attack of the aerodynamic body in-flight to produce an aerodynamic effect to modify a flight path of the aerodynamic body.

10. The system of claim 9, wherein the aerodynamic body is a projectile or is a portion of a projectile.

11. The system of claim 9, wherein the mass is or includes a payload of the projectile.

12. The system of claim 11, wherein the payload is a warhead.

13. The system of claim 1, wherein the actuation system includes a controller configured to determine a timing and amplitude to move the mass as a function of the rotation angle of the spinning structure.

14. The system of claim 12, wherein the controller is configured to output a command to cause motion of the mass such that the mass is phased and/or timed with the rotation angle of the projectile to induce an internal torque to correct a projectile flight toward a desired direction.

15. The system of claim 12, wherein the controller is configured to output the command once per multiple revolutions of the spinning structure to cause actuation of the mass once per multiple revolutions of the spinning structure to reduce energy consumption.

16. The system of claim 12, wherein the spin has a frequency greater than 10 Hz.

17. The system of claim 16, wherein the controller is configured to:

receive rotational position information and/or location information; and determine the command as a function of the received rotational position information and/or location information to cause a motion of the mass that results in a desired movement of the spinning structure.

18. A projectile, comprising:

a spinning structure configured to spin in-flight;

a mass operatively connected to spinning structure to rotate with the spinning structure about a spin axis of the structure, wherein the mass is configured to be moved relative to the spinning structure during a spin of the spinning structure; and an actuation system configured to move the mass relative to the spinning structure, wherein the actuation system is further configured to control movement of the mass and to synchronize the movement of the mass to a rotation angle of the spinning structure, thereby inducing a synchronous precession torque to the spinning structure in a desired direction to steer the projectile.

19. A non-transitory computer readable medium, comprising computer executable instructions configured to cause a computer to perform a method, the method comprising:

receiving or determining a rotation angle and/or rate of spin of a mass attached to a spinning structure;

determining a timing and amplitude to move the mass as a function of the rotation angle and/or rate of spin to induce a synchronous precession torque on the spinning structure to steer the spinning structure in a desired direction; and outputting a command to an actuator to move the mass and to synchronize the movement of the mass to a rotation angle of the spinning structure.

20. The non-transitory computer readable medium of claim 19, wherein outputting the command includes outputting a command to cause motion of the mass such that the mass is phased and/or timed with the rotation angle of the spinning structure to correct a flight path of the spinning structure toward a desired location.

* * * * *